US007896325B2

(12) United States Patent
Carey

(10) Patent No.: US 7,896,325 B2
(45) Date of Patent: Mar. 1, 2011

(54) HOLDING APPARATUS

(76) Inventor: Jamal Carey, Detroit, MI (US)

( * ) Notice: Subject to any disclaimer, the term of this patent is extended or adjusted under 35 U.S.C. 154(b) by 425 days.

(21) Appl. No.: 12/175,887

(22) Filed: Jul. 18, 2008

(65) Prior Publication Data

US 2010/0013135 A1 Jan. 21, 2010

(51) Int. Cl.
*B25B 1/20* (2006.01)

(52) U.S. Cl. ..... 269/45; 269/71; 269/131

(58) Field of Classification Search ..... 269/45, 269/71, 131, 130, 47
See application file for complete search history.

(56) References Cited

U.S. PATENT DOCUMENTS

| | | | | | |
|---|---|---|---|---|---|
| 273,187 | A * | 2/1883 | Stoody | 269/45 |
| 420,459 | A * | 2/1890 | Melcotte | 269/71 |
| 450,474 | A * | 4/1891 | Parker | 269/45 |
| 546,421 | A * | 9/1895 | Duke | 269/9 |
| 558,333 | A * | 4/1896 | Work | 269/45 |
| 681,283 | A * | 8/1901 | Waynick | 81/3.43 |
| 860,569 | A * | 7/1907 | Pool | 269/71 |
| 1,065,979 | A * | 7/1913 | Spencer | 269/9 |
| 1,199,500 | A * | 9/1916 | Salchli | 269/54.3 |
| 1,236,246 | A * | 8/1917 | Amelung | 269/55 |
| 1,569,275 | A * | 1/1926 | Green | 269/130 |
| 1,569,841 | A * | 1/1926 | Mann | 269/130 |
| 2,392,549 | A * | 1/1946 | Rice | 269/71 |
| 2,549,084 | A * | 4/1951 | Heth | 248/346.04 |
| 2,743,435 | A * | 4/1956 | Wayne | 348/826 |
| 3,318,592 | A * | 5/1967 | Steffen | 269/45 |
| 3,764,126 | A * | 10/1973 | Arenas | 269/60 |
| 3,858,866 | A * | 1/1975 | Armstrong et al. | 269/46 |
| 4,171,800 | A * | 10/1979 | Weaver | 269/75 |
| 4,307,877 | A * | 12/1981 | Rogos | 269/46 |
| 4,685,859 | A * | 8/1987 | Marshall, Jr. | 414/590 |
| 4,686,925 | A * | 8/1987 | Stuck | 114/224 |
| 4,756,351 | A * | 7/1988 | Knutsen | 144/379 |
| 4,872,654 | A * | 10/1989 | Seele | 269/3 |
| 5,383,653 | A * | 1/1995 | Stuck | 269/17 |
| 5,934,656 | A * | 8/1999 | Carder | 269/43 |
| 7,581,722 | B2 * | 9/2009 | Garry et al. | 269/296 |

* cited by examiner

*Primary Examiner*—George Nguyen
(74) *Attorney, Agent, or Firm*—Dobrusin & Thennisch PC

(57) ABSTRACT

A holding apparatus for securing an object is disclosed. The holding apparatus secures the object allowing access to the object from different angles and positions. The holding apparatus can be rotated while the object is attached providing access to different areas of the object. The holding apparatus can easily and quickly secure the object.

20 Claims, 8 Drawing Sheets

HOLDING APPARATUS

FIELD OF THE INVENTION

The present invention relates to a holding apparatus. The holding apparatus quickly secures an object allowing access to the object from a wide range of angles and along three axes. While securing the object, the holding apparatus can be rotated permitting access to different areas of the object from different angles.

BACKGROUND OF THE INVENTION

There are many varieties of work holding devices in the tool industry. These holding devices hold and secure an object in place allowing a user to work on the object without the object moving. Traditional work holding devices limit access to certain areas of held objects by either creating a barrier hindering access to desired parts of the object or awkwardly positioning the object limiting access to desired areas. Traditional holding apparatus are often cumbersome and require time and significant effort to secure the object.

The present invention overcomes one or more of these problems.

SUMMARY OF THE INVENTION

Applicant's holding apparatus eliminates many of the drawbacks of prior holding devices. One advantage of Applicant's holding apparatus is that it secures an object in place without obstructing access to a majority of the object's area. Moreover, while securing the object, the holding apparatus and the secured object can be rotated to a different orientation. Furthermore, the object can be easily secured in a different orientation within the holding apparatus to facilitate access to different areas and regions of the object. If a user of the holding apparatus is having difficultly accessing a component on the object, such as a screw, the holding apparatus and the secured object can be rotated to help facilitate access to that component, the user can also move to a different position to attempt to gain access, and/or the secured object can be repositioned in the holding apparatus. One particular use of Applicant's holding apparatus is to secure a model vehicle so that a user may perform modifications to the vehicle. For example, Applicant's holding apparatus can secure a radio controlled (R/C) car allowing the user to quickly make adjustments or replace parts on the R/C car. The holding apparatus may include a base station for supporting the holding apparatus, for catching and retaining any leaking fluids from the vehicle, for providing a cushioning catch for any falling parts like small screws, springs or any other component of the object, and as a storage unit.

Applicant's holding apparatus provides a new and improved holding tool for holding objects that quickly and easily secures an object permitting a user to access areas of the secured object that would be difficult to access by previous holding devices. Applicant's holding apparatus is portable, light weight and folds into a compact and easily storable configuration. One particular use for Applicant's holding apparatus is in the radio controlled (R/C) vehicle hobby. R/C enthusiasts take great pride in their R/C vehicles. They maintain their vehicles with the upmost care and attention. R/C vehicles are comprised of many intricate parts that are often difficult to access and remove or attach due to their location on the R/C vehicle. Applicant's holding apparatus is a valuable tool for R/C enthusiasts; allowing them to safely secure and hold a R/C vehicle in a variety of positions and orientations, permitting R/C enthusiasts access to areas that would be otherwise difficult to access. Using Applicant's holding apparatus; R/C enthusiasts can attach or remove components from their vehicle with less risks of damaging the vehicle compared with previous methods and tools. Applicant's holding apparatus can also be used as a carrier for R/C vehicles; by securing the R/C vehicle in the holding apparatus, users can easily and safely transport the vehicle from one location to another.

DETAILED DESCRIPTION

Figure 1:
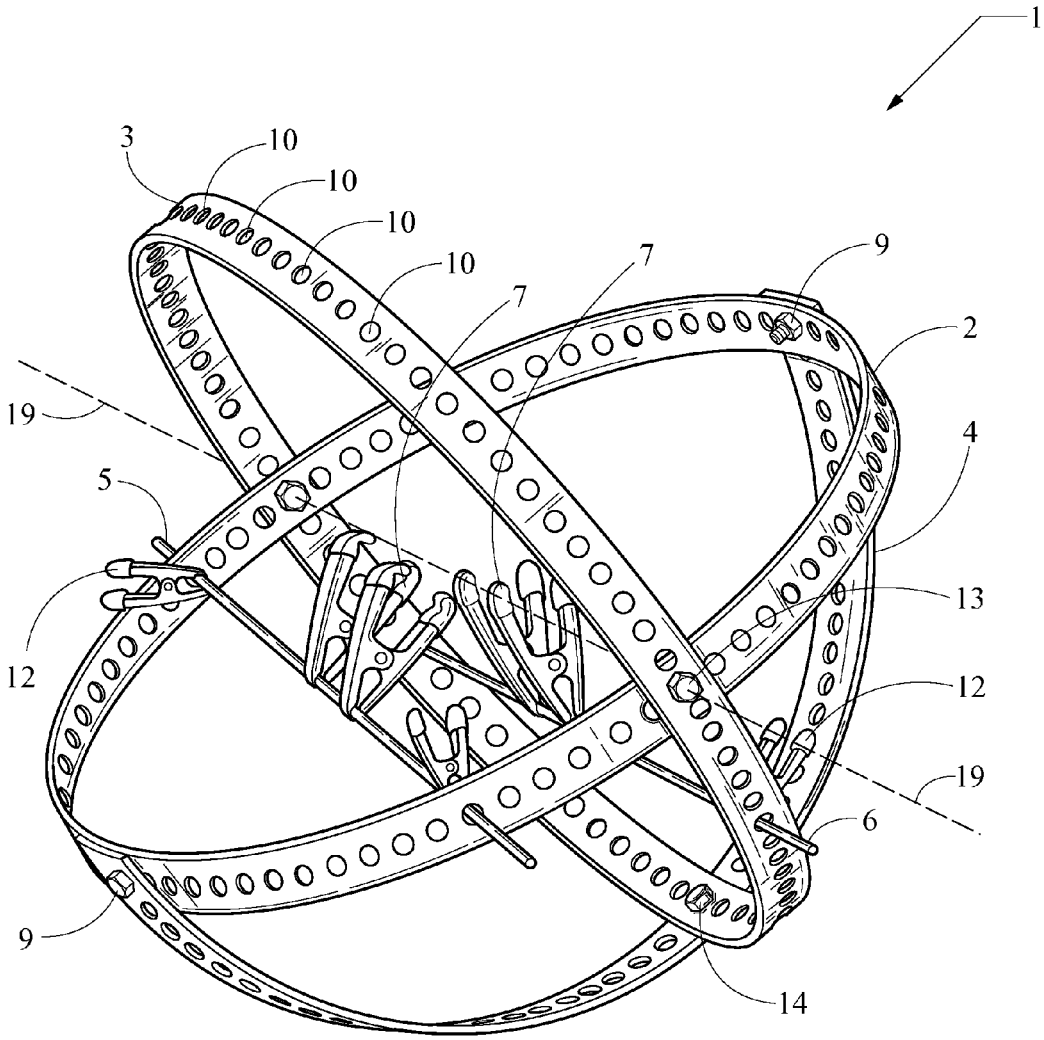
FIG. 1 illustrates an embodiment of the holding apparatus in a closed or unfolded position.
Figure 2:
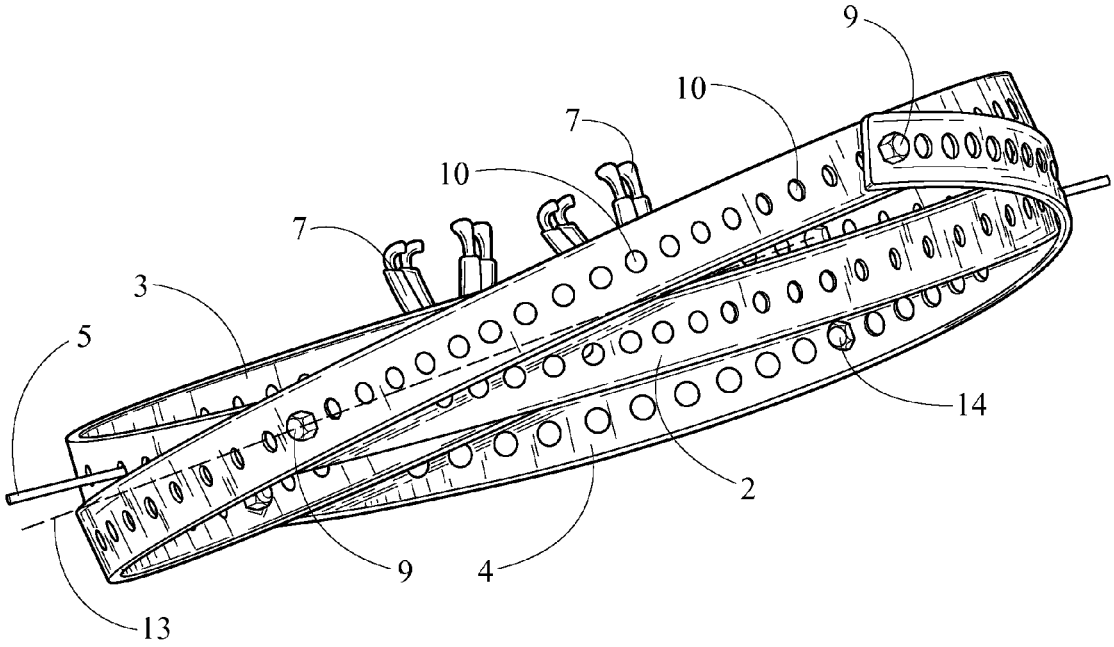
FIG. 2 illustrates an embodiment of the holding apparatus in an open or folded position.

FIG. 2 shows an embodiment of the holding apparatus in an open (folded) position. From an open position, a first ring 2 and a second ring 3 can be rotated to a closed (unfolded) position as shown in FIG. 1. A stabilizer bar 4 can also rotate from a planar position with the first ring 2 as shown in FIG. 2 or to a perpendicular position to the first ring 2 as shown in FIG. 1. It is also important to note that the stabilizer bar can freely rotate 360 degrees if a user desires to have his work held in an inverted position.

FIG. 1 shows one embodiment of the holding apparatus 1 in a closed position. The first ring 2 and the second ring 3 can attach to each other at attachment 13 by rivets allowing the rings to rotate from an open position as depicted in FIG. 2 to a closed position as depicted in FIG. 1 along an axis of rotation 19. The first ring 2 and the second ring 3 attach to each other by using rivets, or any other known attaching mechanism that permits the rings to rotate along a common axis, such as but not limited to rivets, bolts, nuts, and washers, pins, shafts and retaining pins among others. The stabilizer bar 4 attaches to one of the rings. As shown in FIG. 1, the stabilizer bar 4 attaches to the first ring 2 at attachment 9 so that the stabilizer bar 4 can be rotated from a planar position with the first ring 2 as shown in FIG. 2 or to a perpendicular position relative to the first ring 2 as shown in FIG. 1. The stabilizer bar 4 can attach to the first ring 2 similarly to the mechanism used for attaching the first ring 2 and the second ring 3 together at attachment 13. The stabilizer bar 4, when rotated at attachment 9, moves along the perimeter of the second ring 3. The second ring 3 can be locked in place to stabilizer bar 4 by a locking mechanism 14. The stabilizer bar 4 can be locked with second ring 3 at different locations along second ring 3. When the stabilizer bar 4 is locked with the second ring 3, the holding apparatus 1 assumes a fixed position. When the locking mechanism 14 is engaged, the second ring 3 and the first ring 2 can no longer rotate. The locking mechanism 14 can be a simple nut and bolt assembly that passes through openings in the second ring 3 or any other known attaching mechanism known in the art for locking the second ring 3 and the stabilizer bar 4 together, such as, but not limited to, clamps, retaining clips, bolts, nuts and washers among others.

In FIG. 1, a first rod 5 and a second rod 6 are removably attached to the first ring 2 and the second ring 3 respectfully. The first rod 5 and the second rod 6 can be removably attached to the first ring 2 and the second ring 3 with clamps or any other known attaching mechanism known in the art for removably attaching, such as but not limited to, bolts, nuts, and washer, retaining clips, locking pins among others. In FIG. 1, the first rod 5 and the second rod 6 are removably attached to the first ring 2 and the second ring 3 by inserting the rods through adjustment slots 10. The adjustment slots 10 line at least a portion of the perimeter of the first ring 2 and the second ring 3. The adjustment slots 10 permit a user to adjust the holding apparatus so that it may secure objects of varying sizes. Attaching the first rod 5 and the second rod 6 further away from the axis of rotation 19 on the first ring 2 and the second ring 3 respectfully allows for larger objects to be secured. By moving the first rod 5 and the second rod 6 to adjustment slots further away from the axis of rotation 19, the first rod 5 and the second rod 6 end up further apart when the holding apparatus is in the closed position. Attaching the first rod 5 and the second rod 6 closer to the axis of rotation 19 on the first ring 2 and the second ring 3 respectfully allows for smaller objects to be secured. By moving the first rod 5 and the second rod 6 to adjustment slots closer to the axis of rotation 19, the first rod 5 and the second rod 6 end up closer together when the holding apparatus is in the closed position. The first rod 5 and the second rod 6 can be secured to the first ring 2 and the second ring 3 respectfully by rod clamps 12. The rod clamps 12 are removably attached to the first rod 5 and the second rod 6; securing each rod to its respected ring. Clamp grips 7 are removably attached to the first rod 5 and the second rod 6.

Figure 4:
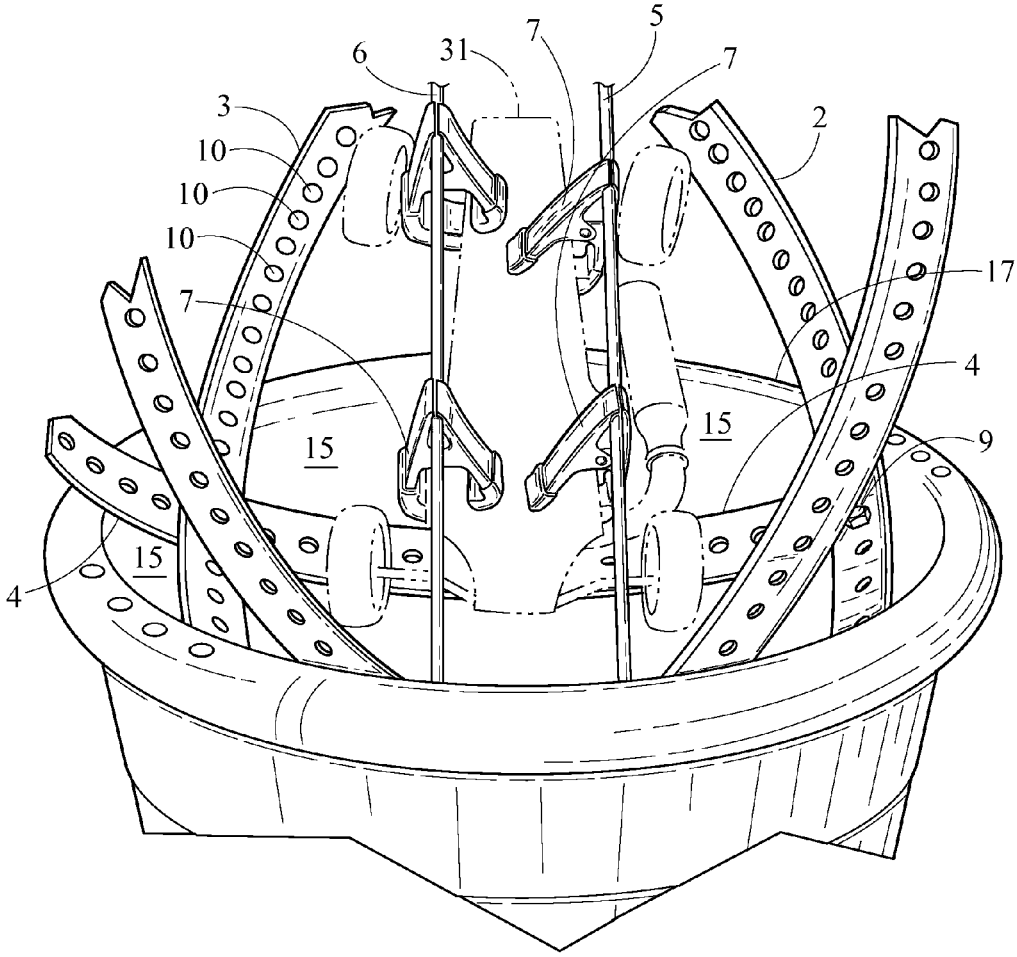
FIG. 4 illustrates an embodiment of the holding apparatus securing a model R/C car supported by a base station.
Figure 5:
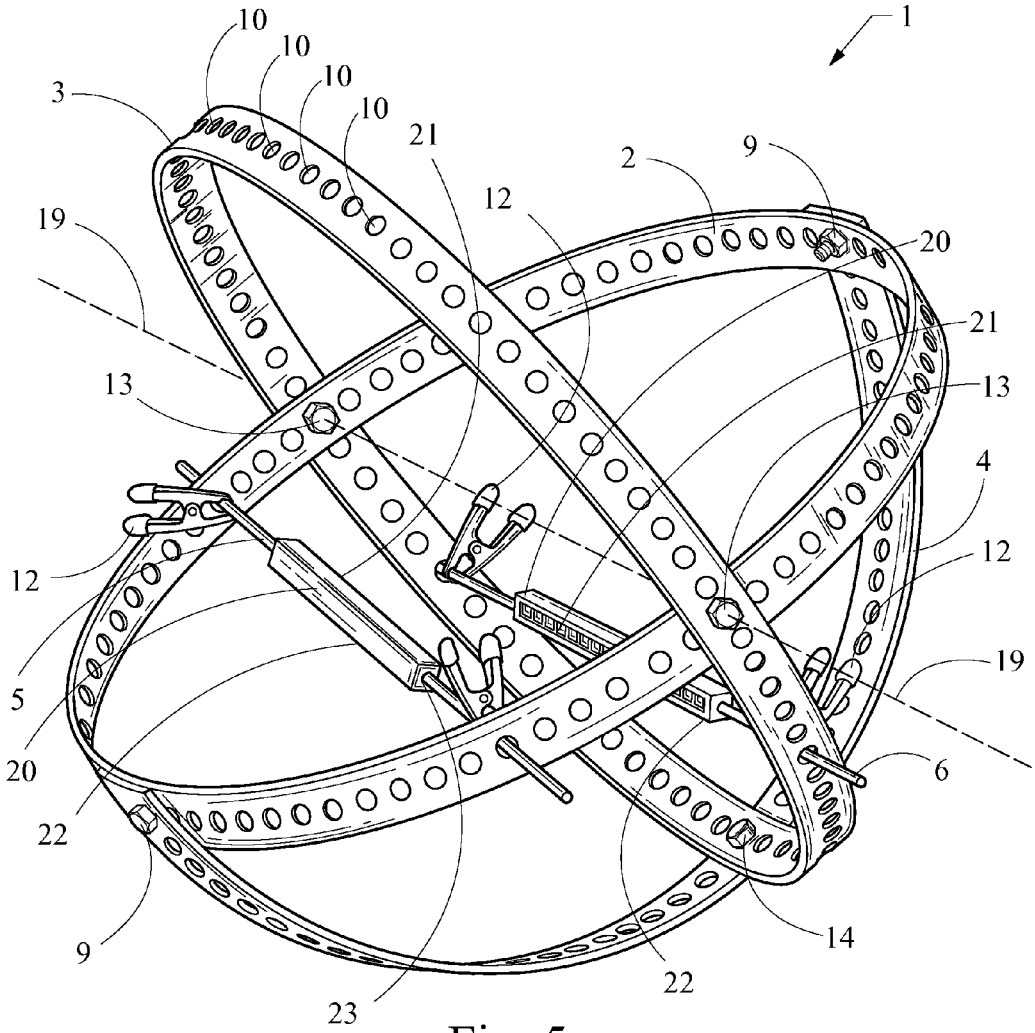
FIG. 5 illustrates an embodiment of the holding apparatus using tubular grips.
Figure 6:
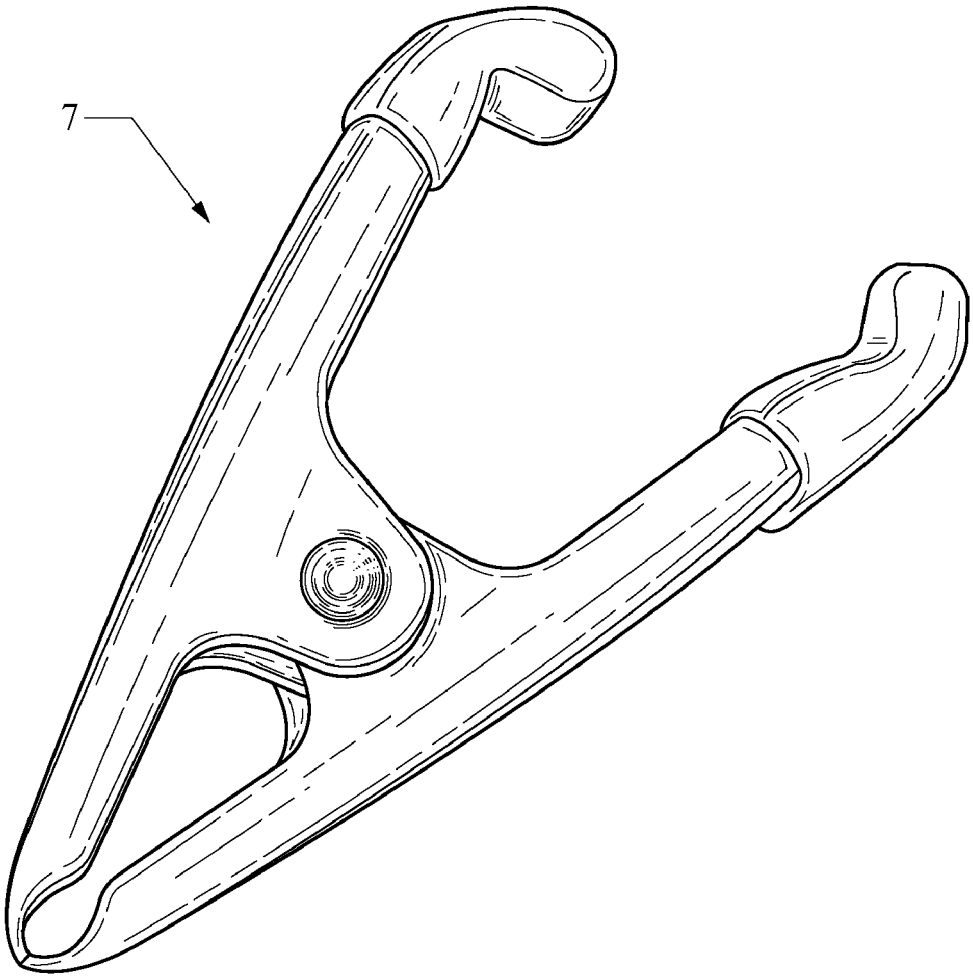
FIG. 6 illustrates an embodiment of a clamp grip.
Figure 7:
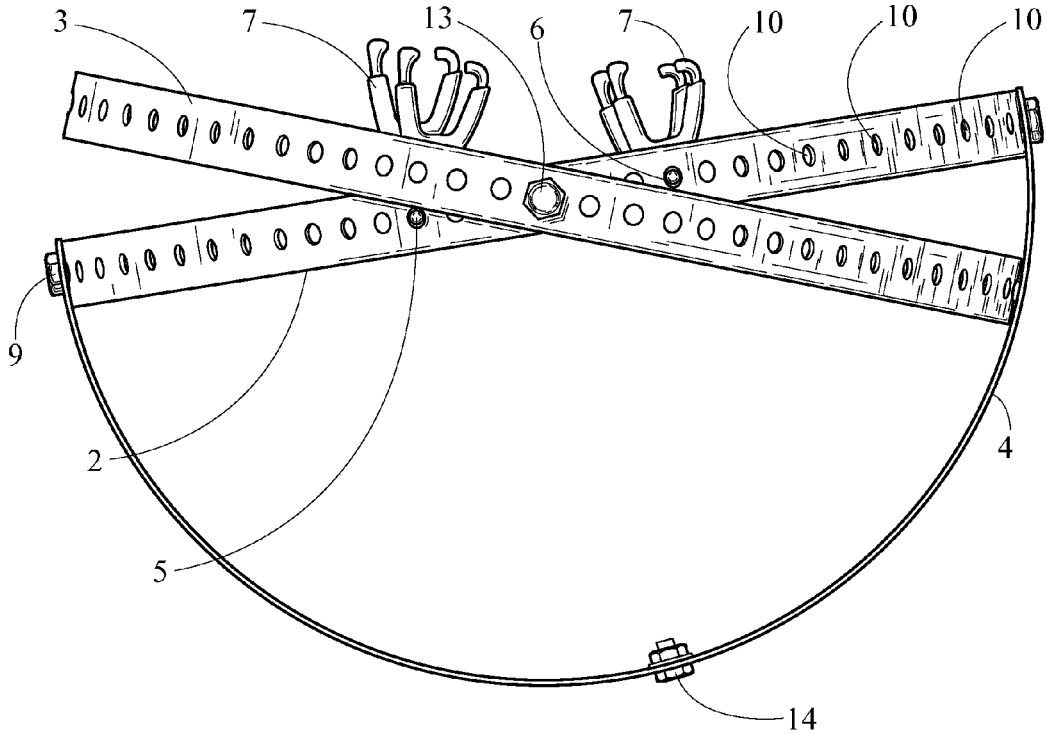
FIG. 7 illustrates an embodiment of the holding apparatus in a closed or unfolded position.
Figure 8:
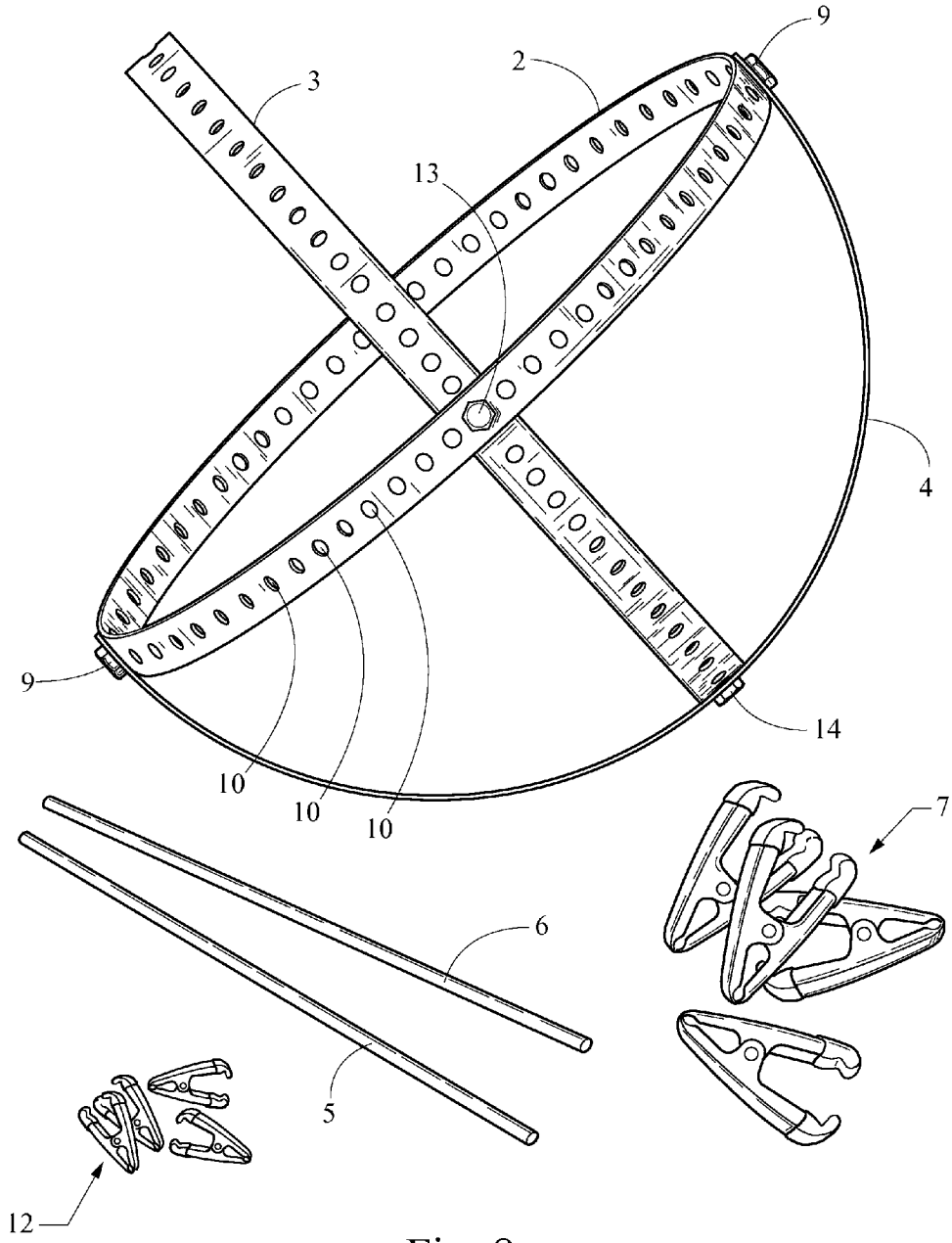
FIG. 8 illustrates an embodiment of the holding apparatus partially dissembled.

When securing an object, depending on the dimensions of the object; the clamp grips 7 can be positioned in different orientations along the first rod 5 and the second rod 6. For example, on a triangular shaped model car chassis, the clamp grips 7 can be positioned so that the longer angled ends of the clamp grips 7 are oriented toward the outer portion of the rings at the wide portion of the chassis. While at the narrower end of the chassis, the longer angled ends of the clamp grips 7 are oriented toward the inner portion of the rings as shown in FIG. 4. It is also important to note that the clamp grips 7 can be oriented in a variety of orientations depending on the object being secured. For example, on an irregularly shaped object, it may be the case that adjacent grips on the first rod 5 and the second rod 6 are positioned so that the longer angled end of a grip on the first rod 5 is facing the shorter end of an adjacent grip on the second rod 6. The ends of the clamp grips 7 are preferably coated with a soft material, such as rubber, to prevent the scratching of the secured object. FIG. 5 shows a different embodiment of grips comprising tubular grips 20 with a cushioned face 21, or vise jaws. The tubular grips can include a weighted portion 22 to position the cushioned face of the tubular grips vertically and towards the secured object when inserted into the rods. The rods are inserted into openings 23 of the tubular grips.

Figure 3:
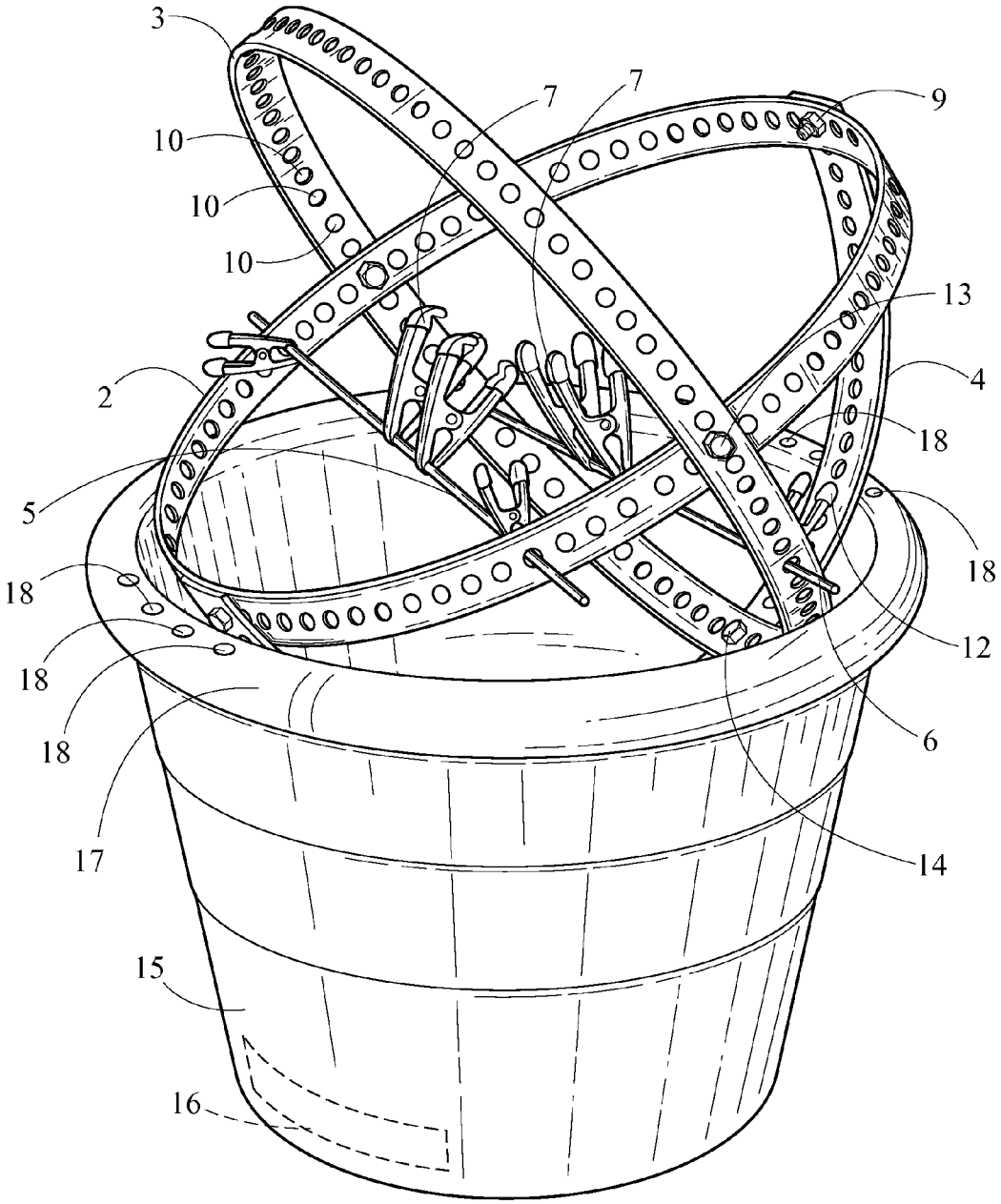
FIG. 3 illustrates an embodiment of the holding apparatus in the closed position supported by a base station.

FIG. 3 shows an embodiment of the holding apparatus comprising a base station 15. The holding apparatus 1 is seated on the base station 15. Preferably, the holding apparatus 1 is positioned in the base station 15 with the stabilizer bar 4 facing downward. The diameter of the base station 15 allows the holding device to sit firmly in the base station 15. A magnetic strip 16 is positioned in the interior of base station 15 for attracting magnetically attractable objects such as screws that fall into the base station. A lip 17 of the base station contains slots 18 for holding parts and tools such as shocks, bolts, and/or screwdrivers.

An object such as R/C car 31 is secured in the holding apparatus 1 by placing the holding apparatus in the open position. The holding apparatus is transferred from the closed position to the open position by opening the holding apparatus by disengaging locking mechanism 14 and moving the first ring 2 and second ring 3 into a more flattened position relative to each other as shown in FIG. 2. If not already attached, the first rod 5 and second rod 6 are attached and secured to their respected rings. R/C car 31 is placed into the interior of the holding apparatus. In FIG. 4, the first rod 5 and the second rod 6 are placed into adjustment slots 10; the adjustment slots used are determined by the size of the R/C car. For cars with larger chassis, it is preferred to use insertion slots further away from the axis of rotation 19. The clamp grips 7 are positioned so that the R/C car rests on the ends of the clamp grips 7. The clamp grips 7 support and keep the R/C car from sliding off while the weight of R/C car 31 holds the R/C car in place. The ends of clamp grips 7 are oriented to suit the particular dimension of the R/C car. Holding apparatus 1 is moved into a closed position by moving the first ring 2 and the second ring 3 into a more spherical configuration with each other as shown in FIG. 1. As the holding apparatus closes the first rod 5 and second rod 6 move closer together, when the holding apparatus is fully in the closed position, the first rod 5 and second rod 6 will have moved closer together causing the tips of the grips to grip the edges of the R/C car chassis. If for some reason the grip is not tight or strong enough, or too tight, adjustments can be made to tighten or loosen the grip. These adjustments, among others, include moving the first rod 5 and second rod 6 to insertion slots closer or further to the axis of rotation 19, or adjusting the position or orientation of the clamp grips 7.

When the gripping force applied by the holding apparatus is strong enough to hold the R/C car in place the locking mechanism 14 is engaged locking the second ring 3 with the stabilizer bar 4. The locking mechanism 14 can be a simple bolt that screws into place, a clamp, or any other mechanism for removably attaching the second ring 3 with stabilizer bar 4. When the locking mechanism 14 is engaged, R/C car 31 is secured on the holding apparatus 1. Holding apparatus 1 can now be seated into the base station. While seated in the base station, a user can perform work on his R/C car (or any other object that he is able to secure in holding device). If the R/C car where to leak any fluid, the fluid would fall and be trapped in the base station 15. If a magnetically attractable part fell from the R/C car it would land within the interior of the base station and could be attracted to a magnet 16. To release the R/C car, the locking mechanism 14 is disengaged and the holding apparatus is moved to the open position. By opening the holding apparatus, the first rod 5 and the second rod 6 move apart releasing the gripping force on the R/C car.

A user of holding device may need to perform adjustments the first time a particular object is secured. The adjustment consists of changing the location of the first rod 5 and the second rod 6 on their respected rings. The locations of the first rod 5 and the second rod 6 can be changed by detaching the rods from the adjustment slots and inserting them into different adjustment slots along the perimeter of their respected rings. The adjustment slots used depend on the size of the object being secured. With larger objects, the adjustment slots used are further away from the axis of rotation 19. The location and orientation of the clamp grips 7 can also be adjusted to properly secure an object allowing the user to secure objects of varying sizes and shapes. Once the needed adjustments are made the user can conveniently use these same settings to quickly secure and release any model car or object that shares the same adjustments.

What is claimed is:

1. A holding apparatus comprising:

a first ring comprising:

a first rod attaching to the first ring, the first rod comprising at least one first grip, a stabilizer bar rotationally attaching to the first ring;

a second ring comprising:

a second rod attaching to the second ring; the second rod comprising at least one second grip;

wherein the first ring and the second ring rotationally attach to each other, further wherein the stabilizer bar removably attaches to the second ring.

2. The holding apparatus of claim 1, wherein the first rod is removably attachable at different regions along the perimeter of the first ring.

3. The holding apparatus of claim 1, wherein the second rod is removably attachable at different regions along the perimeter of the second ring.

4. The holding apparatus of claim 1, wherein the first grip is rotatable and moveable along an axis of the first rod.

5. The holding apparatus of claim 1, wherein the second grip is rotatable and moveable along an axis of the second rod.

6. The holding apparatus of claim 1; wherein the first and second rings are circular.

7. The holding apparatus of claim 1, further comprising a support base station comprising a lip.

8. The holding apparatus of claim 7, wherein the lip of the support base station contains at least one slot.

9. The holding apparatus of claim 7, wherein at least one magnetic strip is attached to the support base station.

10. A holding apparatus comprising:

a first ring comprising:

a first rod attaching removably to two locations of the first ring, the first rod comprising at least two first grips, wherein the first rod is attachable to different areas along the perimeter of the first ring;

a stabilizer bar attaching rotationally to two locations of the first ring;

a second ring comprising:

a second rod attaching removably to two locations of the second ring, the second rod comprising at least two second grips, wherein the second rod is attachable to different areas along the perimeter of the second ring;

wherein the first ring and the second ring are rotationally attached to each other at two locations, further wherein the stabilizer bar removably attaches to the second ring.

11. The holding apparatus of claim 10, wherein the first grips are rotatable and moveable along an axis of the first rod.

12. The holding apparatus of claim 10, wherein the second grips are rotatable and moveable along an axis of the second rod.

13. The holding apparatus of claim 10; wherein the first and second rings are circular.

14. The holding apparatus of claim 10, further comprising a support base station comprising a lip.

15. The holding apparatus of claim 14, wherein the lip of the support base station contains at least one slot.

16. The holding apparatus of claim 14, wherein at least one magnetic strip is attached to the support base station.

17. A holding apparatus comprising:

a first circular ring comprising:

a first rod removably attaching to two locations of the first ring, the first rod comprising at least two first grips that are rotatable and moveable along an axis of the first rod, wherein the first rod is attachable to different areas along the perimeter of the first ring;

a stabilizer bar attaching rotationally to two locations of the first ring;

a second circular ring comprising:

a second rod attaching removably to two locations of the second ring, the second rod comprising at least two second grips that are rotatable and moveable along an axis of the second rod, wherein the second rod is attachable to different areas along the perimeter of the second ring;

wherein the first ring and the second ring are rotationally attached to each other at two locations, further wherein the stabilizer bar removably attaches to the second ring.

18. The holding apparatus of claim 17, further comprising a support base station comprising a lip.

19. The holding apparatus of claim 18, wherein the lip of the support base station contains at least one slot.

20. The holding apparatus of claim 18, wherein at least one magnetic strip is attached to the support base station.

* * * * *